US005979163A

United States Patent [19]

Hanners et al.

[11] Patent Number: 5,979,163

[45] Date of Patent: Nov. 9, 1999

[54] ROTATIONALLY PIVOTAL MOTION CONTROLLER

[75] Inventors: H. Steven Hanners, Bremerton; Charles P. Bodony, Bainbridge Island, both of Wash.

[73] Assignee: Circular Motion Controls, Inc., Bremerton, Wash.

[21] Appl. No.: 08/999,461

[22] Filed: Dec. 29, 1997

[51] Int. Cl.[6] ..... F01C 9/00; F15B 7/00

[52] U.S. Cl. ..... 60/571; 92/121; 92/122; 92/128; 92/143

[58] Field of Search ..... 92/121, 122, 125, 92/128; 91/210, 51; 188/306, 296, 317, 313; 60/369, 571; 192/58.9

[56] References Cited

U.S. PATENT DOCUMENTS

| | | | |
|---|---|---|---|
| 740,473 | 10/1903 | Scherer | 188/313 |
| 933,076 | 9/1909 | Houdaille | 188/317 |
| 1,820,971 | 9/1931 | Gruenfeldt | 188/306 |
| 1,920,098 | 7/1933 | Moorhouse | 188/308 |
| 2,019,440 | 10/1935 | Watson | 188/306 |
| 2,350,066 | 5/1944 | Parker | 92/121 |
| 2,854,956 | 10/1958 | Hager | 92/121 |
| 3,444,789 | 5/1969 | Hansen | 92/121 |
| 3,750,535 | 8/1973 | Higuchi | 92/121 |
| 3,968,731 | 7/1976 | Myers | 91/407 |
| 4,098,597 | 7/1978 | Nebelung | 65/181 |
| 4,345,509 | 8/1982 | Bridwell et al. | 92/78 |
| 4,565,119 | 1/1986 | Higuchi | 92/125 |
| 4,633,759 | 1/1987 | Schulze | 91/368 |
| 4,716,996 | 1/1988 | Hummel | 188/306 |
| 4,759,186 | 7/1988 | Sugden | 60/473 |
| 4,768,630 | 9/1988 | Aubry et al. | 188/290 |
| 4,817,504 | 4/1989 | Lieberman | 92/125 |
| 4,886,149 | 12/1989 | Uehara et al. | 188/306 |
| 5,440,970 | 8/1995 | Tonsor | 92/121 |
| 5,492,051 | 2/1996 | Schiffler et al. | 92/125 |
| 5,516,133 | 5/1996 | Motrenec et al. | 188/306 |
| 5,813,316 | 9/1998 | Sekiya et al. | 92/121 |

*Primary Examiner*—John E. Ryznic
*Attorney, Agent, or Firm*—Price, Heneveld, Cooper, DeWitt & Litton

[57] ABSTRACT

A rotationally pivotal motion controller pivotally interconnects two adjoining elements and controls the pivotal motion of a first of the two adjoining elements with respect to a second of the two adjoining elements. The rotationally pivotal motion controller comprises a housing having a wall which defines an axial cylindrical bore through the housing. The wall is adapted for attachment to a first of the two adjoining elements and the wall also has a longitudinal aperture therethrough which communicates with the bore. A hub assembly comprises a hub which is at least partially disposed within the cylindrical bore of the housing and is axially rotatable therein. The hub has a substantially central cylindrical core and at least one lobe extending radially from the core. At least one end cap is affixed to one end of the hub to retain the hub in a fixed, fluidically sealed, axial relationship within the housing. The hub and the housing together define at least one fluid retention cavity. The hub assembly is adapted for attachment to a second of the two adjoining elements. A removable wiper is positioned in the aperture and is sealingly affixed to the housing. The wiper extends radially inwardly from the housing wall within the fluid retention cavity and extends to the central cylindrical core thereby dividing the fluid retention cavity into a first minor cavity and a second minor cavity.

31 Claims, 6 Drawing Sheets

ROTATIONALLY PIVOTAL MOTION CONTROLLER

BACKGROUND OF THE INVENTION

The present invention relates to devices which control the pivoting relationship between two adjoining members, and in particular, to devices having two members rotationally pivotal one with respect to the other and having a fluid as an operating medium to provide the control function.

Pivotal or rotational control devices for use as dampers to control the rotational rate of one member with respect to another are well-known in the art. Rotational dampers typical comprise an outer stator and an internal rotor which define between them a chamber filled with fluid. Blades disposed substantially radially on each of the stator and rotor divide the internal chamber into one or more smaller chambers, each rotor blade being rotatable about a central axis of the rotor and angularly limited in travel between adjacent fixed stator blades. These dampers also provide for the restricted flow of the internal fluid between adjacent subcavities as the rotor rotates within the stator. The restricted flow of the fluid between chambers providing the desired damping action.

These dampers are typically used in vehicle suspension systems wherein the stator is generally affixed to the vehicle chassis and the rotor is mechanically linked to a vehicle wheel via an arm of the suspension such that as the vehicle encounters a bump, the vertical movement of the wheel is translated by connecting linkage into a pivotal rotation of the damper rotor.

Similarly, hydraulic motors or pivotal actuators also incorporate an external stator and an internal rotor wherein each has one or more radial blades attached thereto. When functioning as an actuator, the actuator is hydraulically connected to an outside source which provides pressurized hydraulic fluid to the interior cavity of the actuator. As pressurized hydraulic fluid is introduced into one of the subchambers, the rotor is induced to rotate within the stator as an equal volume of hydraulic fluid is permitted to exit from the opposite side of the chamber in which the rotor blade is rotating.

The use of such pivotal control devices has found wide spread use in the construction and manufacture of vehicle suspension systems and in other applications. Heretofore, each desired pivotal control function has been typically administered by the addition of separate axial control devices. The incorporating of separate devices for each control function have certain drawbacks and disadvantages, particularly with respect to the cost and space constraints of incorporating separate devices within one functional mechanism.

SUMMARY OF THE INVENTION

One aspect of the present invention is a rotationally pivotal motion controller for pivotally interconnecting two adjoining elements to control the pivotal motion of a first of the two adjoining elements with respect to a second of the two adjoining elements. The rotationally pivotal motion controller comprises a housing having a wall which defines an axial cylindrical bore through the housing. The wall is adapted for attachment to a first of the two adjoining elements and the wall also has a longitudinal aperture therethrough which communicates with the bore. A hub assembly comprises a hub which is at least partially disposed within the cylindrical bore of the housing and is rotatable therein. The hub has a substantially central cylindrical core and at least one lobe extending radially from the core. At least one end cap is affixed to one end of the hub to retain the hub in a fixed, fluidically sealed, co-axial relationship within the housing. The wiper can be removed without disassembling the hub from the housing The hub and the housing together define at least one fluid retention cavity. The hub assembly is adapted for attachment to a second of the two adjoining elements. A removable wiper is positioned in the aperture and is sealingly affixed to the housing. The wiper extends radially inwardly from the housing wall within the fluid retention cavity and extends to the central cylindrical core thereby dividing the fluid retention cavity into a first minor cavity and a second minor cavity.

Another aspect of the present invention is a rotationally pivotal motion controller for pivotally interconnecting two adjoining elements and controlling the pivotal motion of a first of the two adjoining elements with respect to a second of the two adjoining elements. The rotationally pivotal motion controller comprises a housing which has a wall defining an axial cylindrical bore through the housing and wherein the wall is adapted for attachment to a first of the two adjoining elements. The wall has a plurality of longitudinal apertures therethrough communicating with the bore. A hub assembly comprises a hub at least partially disposed within the cylindrical bore of the housing and is rotatable therein. The hub has a substantially central cylindrical core and a plurality of lobes extending radially therefrom. At least one end cap is affixed to one end of the hub thereby retaining the hub in a fixed, fluidically sealed, co-axial relationship within the housing. The hub and the housing together define a plurality of fluid retention cavities. The hub assembly is adapted for attachment to a second of the two adjoining elements. A plurality of wipers are positioned in the apertures and are sealingly affixed to the housing. The wiper can be removed without disassembling the hub from the housing. One of the plurality of wipers extends radially inward from the housing wall at each aperture and within each of the fluid retention cavities, the wiper substantially extending to the central cylindrical core and dividing each of the fluid retention cavities into a first minor cavity and a second minor cavity.

Yet another aspect of the present invention is a rotationally pivotal motion controller for pivotally interconnecting two adjoining elements and controlling the pivotal motion of a first of the two adjoining elements with respect to a second of the two adjoining elements. The rotationally pivotal motion controller comprises a housing having a wall defining an axial cylindrical bore through the housing. The wall is adapted for attachment to a first of the two adjoining elements and has a plurality of longitudinal apertures therethrough communicating with the bore. A hub assembly comprises a hub which is at least partially disposed within the cylindrical bore of the housing and is rotatable therein. The hub has a central cylindrical core and a plurality of lobes extending radially therefrom. At least one end cap is affixed to one end of the hub thereby retaining the hub in a fixed, fluidically sealed, axial relationship within the housing. The hub assembly and the housing together define a plurality of fluid retention cavities. The hub assembly is adapted for attachment to a second of the two adjoining elements. A plurality of wipers are positioned in the apertures and are sealingly affixed to the housing. One of the plurality of wipers extends radially inwardly from the housing wall at each of the apertures and within each of the fluid retention cavities and extends substantially to the central cylindrical core and divide each of the fluid retention cavities into a first minor cavity and a second minor cavity. At least a first of the plurality of wipers is a damper wiper and configures at least a portion of the rotationally pivotal motion controller as an pivotal motion damper for regulating the rate of rotation between the housing and the hub assembly. At least a second of the plurality of wipers is a pump wiper and configures at least a second portion of the rotationally pivotal motion controller as an pivotal motion pump for inducing forced circulation of fluid from one of the fluid retention cavities as a result of reciprocating pivotal motion of the hub assembly with respect to the housing. A cooling radiator has an inlet fluidically interconnected to the pump wiper for receiving heated fluid from the housing and hub assembly. A cooling portion lowers the temperature of the fluid and an outlet is fluidically interconnected to the pump wiper for returning cooled fluid to the fluid retention cavity associated with the pump wiper.

These and other features, advantages and objects of the present invention will be further understood and appreciated by those skilled in the art by reference to the following specification, claims and appended drawings.

DETAILED DESCRIPTION OF PREFERRED EMBODIMENT

Figure 2:
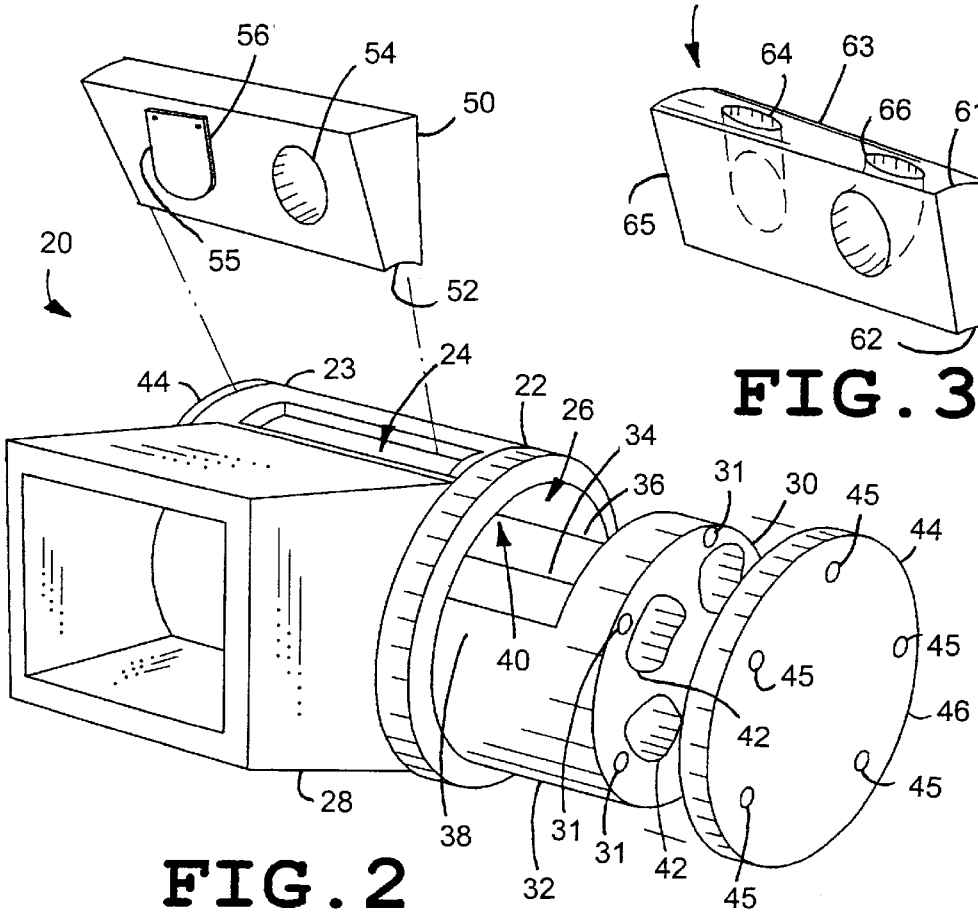
FIG. 2 is an exploded, perspective view of a rotationally pivotal motion controller embodying the present invention, wherein the removable wiper is configured as a damper wiper.

For purposes of description herein, the terms "upper," "lower," "right," "left," "rear," "front," "vertical," "horizontal," and derivatives thereof shall relate to the invention as oriented in FIG. 2. However, it is to be understood that the invention may assume various orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
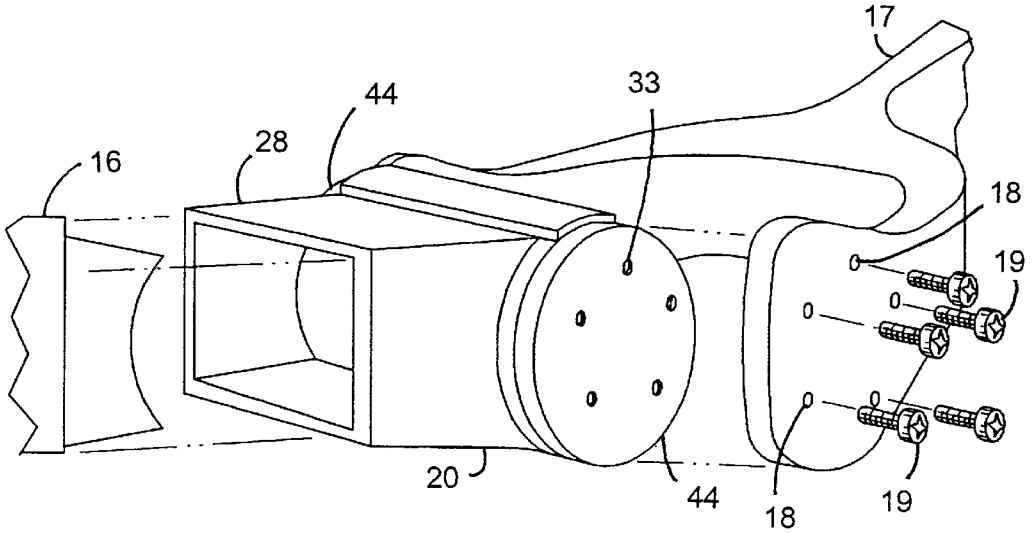
FIG. 1 is an exploded, perspective view of a pivotal joint between two structural members interconnected by a rotationally pivotal motion controller embodying the present invention.

Turning to the drawings, FIG. 1 shows a rotationally pivotal motion controller 20, which is one of the preferred embodiments of the present invention, and illustrates its use as a pivotal joint between two structural members.

Cylindrical hub 30, most easily seen in FIG. 2 includes a wall 23 defining an axial cylindrical bore 26 extending through housing 22. Wall 23 also has at least one longitudinal aperture 24 therethrough communicating with axial cylindrical bore 26. Housing 22 has an attachment feature 28 which is adapted to affix housing 22 to a structural member 16. Attachment feature 28 can vary in configuration from application to application depending upon the structural design of member 16. A cylindrical hub 30 having at least one lobe 32 extending radially from a central cylindrical core 34 is closely received within bore 26 of housing 22. Lobe 32 has radial sides 36 and 38 which define in combination with at least a portion of central core 34 and housing 22 a fluid retention cavity 40. Hub 30 and more particularly lobe 32 can have longitudinal channels 42 extending therethrough. End caps 44 fasten to ends of hub 30 to retain hub 30 in a fixed, fluidically sealed, axial relationship within housing 22. In the preferred embodiment, end caps 44 have a plurality of holes 45 proximate to a periphery 46. Holes 45 are arranged in a pattern in registry with holes 31 in each end of hub 30. Individual fasteners (not shown) can be engaged in holes 45 and 31 to affix end caps 44 to hub 30. As shown in FIG. 1, a second structural member 17, intended to be in a pivotal relationship with first member 16, is attached to end caps 44 with fasteners 19 engaging attachment holes 18 in second member 17 and attachment holes 33 in end caps 44. Attachment holes 33 in end caps 44 are distinct from holes 45.

A damper wiper 50 is received in aperture 24 of housing 22 such that an internal end 52 thereof is in a sealed relationship with a surface of central core 34 of hub 30. Wiper 50 is retained within aperture 24 in a manner to be described below. Wiper 50 is configured as a damper wiper. In the illustrated embodiment, damper wiper 50 has two apertures 54 therethrough permitting the flow of fluid from one side of damper wiper 50 to the other side of damper wiper 50. Each of apertures 54 and 55 has affixed on opposite sides of damper wiper 50 a reed valve 56 such that first and second apertures 54 and 55 permit one-way fluid flow in opposite directions.

Figure 6:
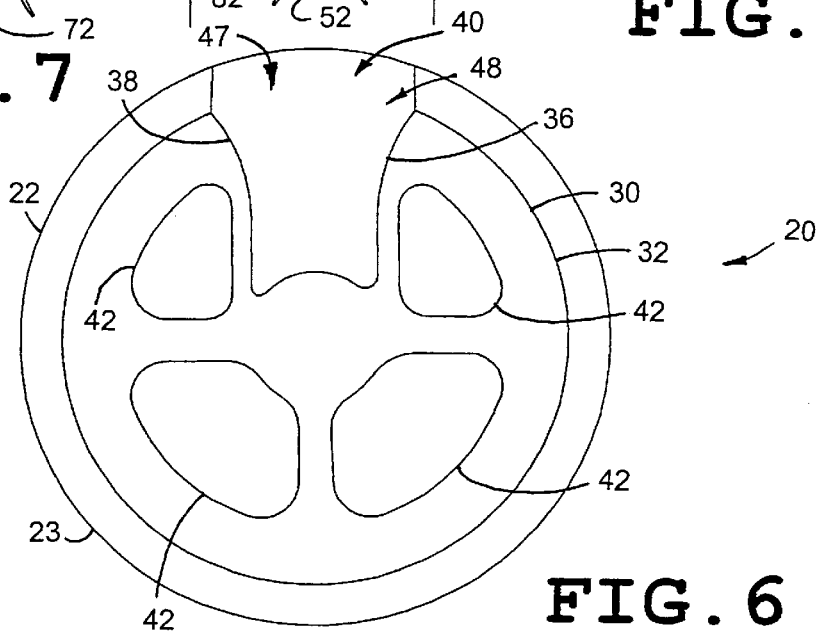
FIG. 6 is an end elevational exploded view of a wiper and wiper cap with respect to the housing and hub.

In operation, a rotationally pivotal motion controller 20 configured with damper wiper 50 as illustrated in exploded end elevation in FIG. 6 illustrates wiper 50 bifurcating fluid retention cavity 40 into first and second minor cavities 47 and 48. When fluid retention cavity 40 is filled with an operating fluid (not shown) and wiper 50 is affixed within aperture 24, in a manner further described below, rotationally pivotal motion controller 20 functions as a damper. As hub 30 is rotated within axial cylindrical bore 26 of housing 22, the volumetric characteristics of minor cavities 47 and 48 change with respect to each other. The changing volume of minor cavities 47 and 48 with respect to each other induce a flow of the working fluid from the minor cavity decreasing in volume to the minor cavity increasing in volume. The flow from one minor cavity to the other minor cavity is facilitated by one-way apertures 54 and 55.

Figure 3:
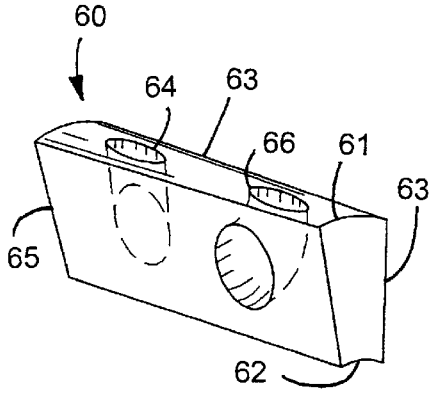
FIG. 3 is a perspective view of an alternate embodiment of the removable wiper, and is configured as an actuator wiper.

FIG. 3 illustrates an actuator wiper 60 which is an alternate wiper embodiment. Actuator wiper 60 has an inner edge 62 to seal against central cylindrical core 34 of hub 30. Actuator wiper 60 has a first aperture 64 extending from outer end 61 to first side 63 and also has a second aperture 66 extending from outer end 61 to second side 65. Actuator wiper 60 is interchangeable with damper wiper 50 in aperture 24 of housing 22.

Figure 8:
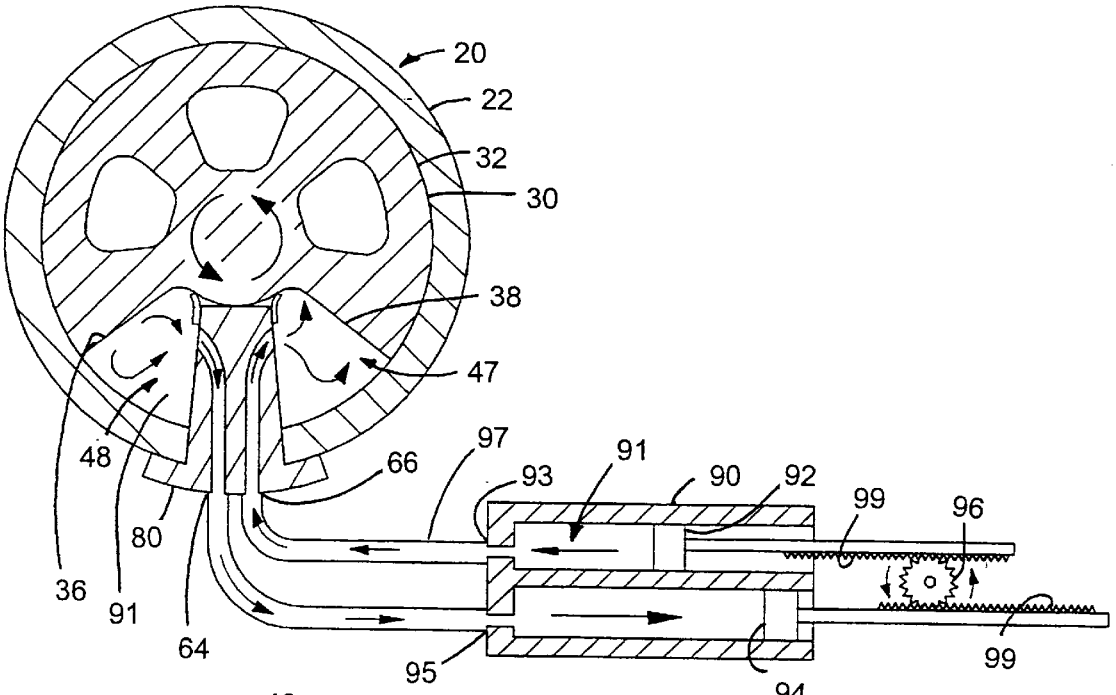
FIG. 8 is a cross-sectional end view of a rotationally pivotal motion controller configured as an actuator showing the pressurized fluid source in schematic representation.

FIG. 8 illustrates axial motion controller 20 functioning as an actuator with wiper 60 engaged in aperture 24. A fluid pump 90 has a first piston 92 and a second piston 94 which are interlinked by rack 99 and pinion 96 such that rotation of pinion 96 results in laterally equal but opposite movement of pistons 92 and 94. Fluid pump 90 is ported at 93 for fluidic connection via fluid line 97 with aperture 66 and is also ported at 95 for fluidic connection with aperture 64 via fluid line 98.

In operation, as rack 99 and pinion 96 are activated to drive piston 92 to the left and piston 94 to the right, fluid medium 91 is forced through fluid line 97 and into first minor cavity 47 while the rightward movement of piston 94 induces a withdrawal of fluid 91 from minor cavity 48. This dual transfer of fluid 91 imparts a counterclockwise rotation of hub 30 by applying a positive force to radial side 38 of lobe 32. When rack 99 and pinion 96 are activated in an opposite direction, a reverse flow of fluid 91 is induced and thereby causes hub 30 to rotate in a clockwise direction by the application of positive fluidic force to radial side 36 of lobe 32 thereby importing the rotationally pivotal motion controller with the functional characteristic of a rotary actuator. Alternatively, in reverse manner, pivotal movement of members 16 and 17 with respect to each other causing a change in the respective volumes of minor cavities 47 and 48 can be utilized to induce the actuation of fluid pump 90 thereby including rotation of pinion 96 to drive an accessory (not shown) attached thereto.

Figure 4:
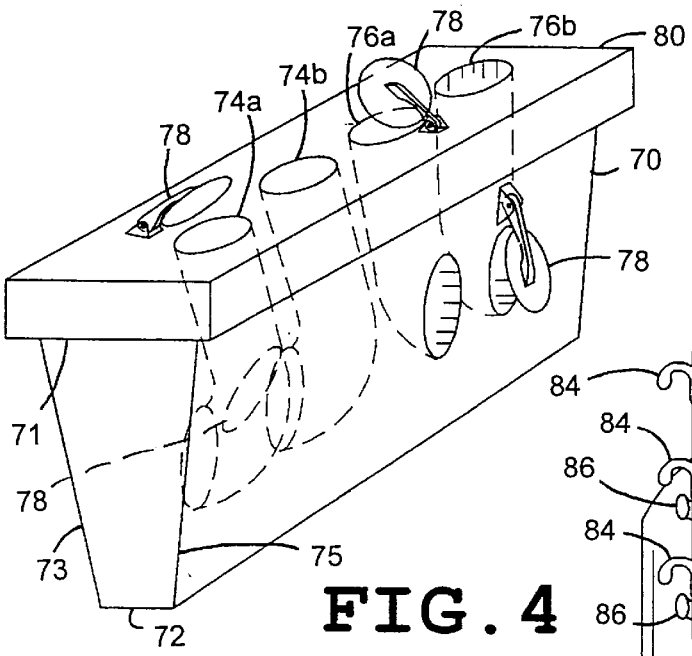
FIG. 4 is a third configuration of the removable wiper, the wiper is configured as a pump wiper.
Figure 7:
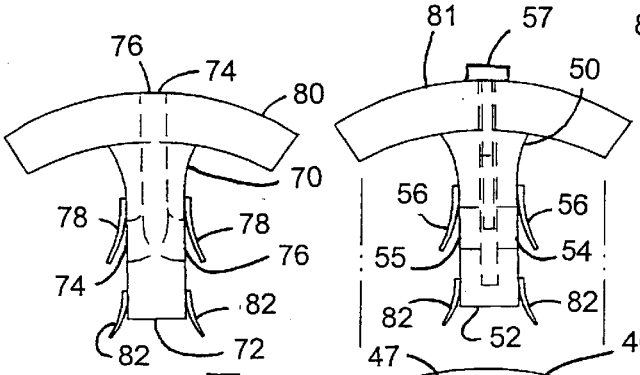
FIG. 7 is an end view of the pump wiper and wiper cap.

Referring now to FIG. 4, yet another wiper embodiment is illustrated as pump wiper 70. Pump wiper 70 has an inner end 72 and an outer end 71, a first side 73, and a second side 75. Pump wiper 70 has a first aperture set 74*a* and 74*b* extending from outer end 71 to first side 73, and a second set of apertures 76*a* and 76*b* extending from outer end 71 to second side 75. Apertures 74*a* and 76*a* have a one-way valve 78 positioned in such a manner as to permit only the outflow of fluid from pump wiper 70. Apertures 74*b* and 76*b* have associated therewith one-way valves 78 arranged to permit the inflow only of fluid from an exterior of pump wiper 70 into fluid retention cavity 40 (FIGS. 2 and 4). Pump wiper 70 as illustrated in FIG. 4 also shows the attachment to upper end 71 of wiper cap 80. As shown in FIG. 7 in an end view thereof, wiper cap 80 is contoured to conform to an exterior of wall 23 of housing 22 as further shown in end elevation in FIG. 6.

Figure 15:
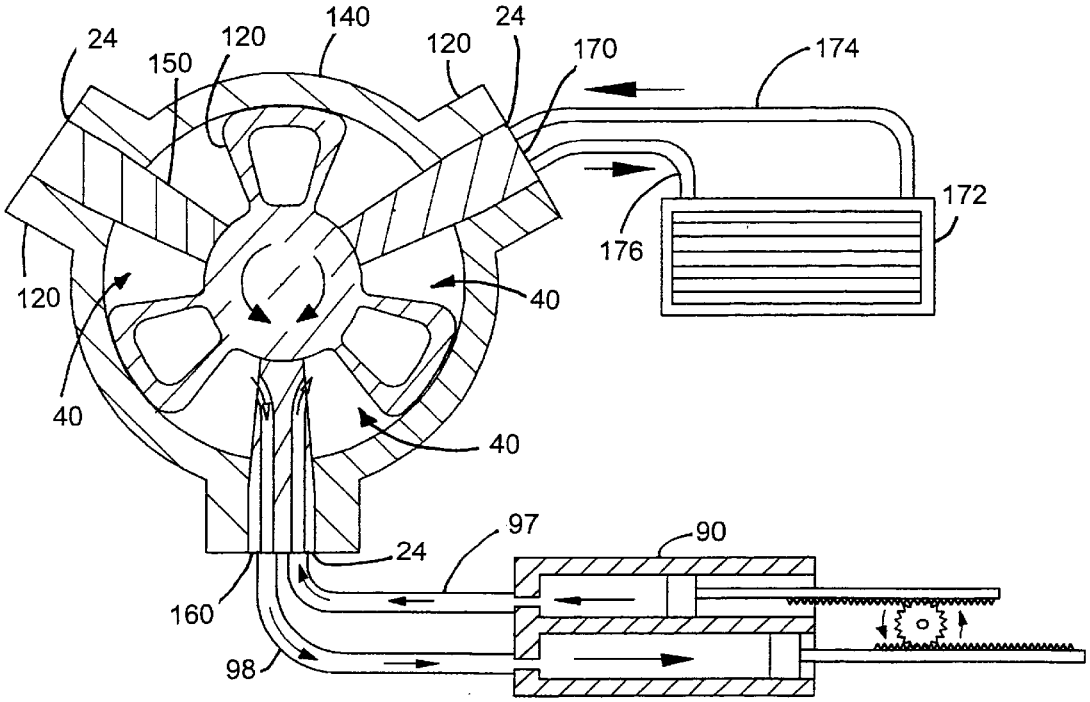
FIG. 15 is a cross-sectional view of a rotationally pivotal motion controller configured to function as a damper, a pump, and an actuator.

In operation, when a pump wiper 70 is engaged within aperture 24 and in cooperation with housing 22 and hub 32 and an operating fluid is contained within fluid retention cavity 40, the rotationally pivotal motion controller acts as a fluid pump. With pump wiper 70 affixed to wiper cap 80 substantially as shown in FIGS. 4 and 15 and affixed to housing 22 similar to the attachment of wiper 50 and wiper cap 81 as shown in FIG. 6, a clockwise rotation of hub 30 with respect to housing 22 induces a volumetric decrease in subcavity 47 and a corresponding volumetric increase in subcavity 48. The operating fluid is substantially incompressible, therefore as the volume of subcavity 47 decreases the working fluid within subcavity 47 is forced through one-way aperture 74 to a fluid transmission line 176 connected thereto. Correspondingly, the increasing volume of subcavity 48 from the clockwise rotation of hub 30 induces an intake of fluid through one-way aperture 76*b* to which is affixed a return fluid line 174. When hub 30 has reached its clockwise rotational limit by contact of wiper 70 with radial side 38 of lobe 32 the fluid contents of subcavity 47 have been substantially expelled from the rotationally pivotal motion controller, and subcavity 48 retains a maximum volume of operating fluid. As hub 30 begins to rotate in a counterclockwise direction, the volumetric capacity of subcavity 48 is decreasing and the volumetric capacity of subcavity 47 is correspondingly increasing. These volumetric changes induce the expelling of working fluid from subcavity 48 through one-way aperture 76*a* and an inflow of operating fluid to said cavity 47 through one-way aperture 74*b*. Typically, apertures 74*b* and 76*b* are fluidically connected to the same fluid transmission line 176 for the outflow of operating fluid from the rotationally pivotal motion controller. Similarly, one-way apertures 74*b* and 76*b* are connected to the same inflow fluid transmission line 174. The inflow and outflow fluid transmission lines 174 and 176 are typically affixed to the input and output ports of an external apparatus which is caused to function by the flow of the operating fluid therethrough as induced by the rotationally pivotal motion controller. Such an external apparatus is shown as cooling radiator 172 in FIG. 15. Alternatively, one-way input apertures 74*b* and 76*b* may be combined within wiper 70, and likewise, output apertures 74*a* and 76*a* can be incorporated into a single valved aperture within wiper 70 in a manner known to those skilled in the pumping arts to present only one input port and one output port from the pump wiper 70.

FIG. 6 illustrates damper wiper 50 attached to an alternate embodiment wiper cap 81. FIG. 6 also shows in end elevation hub 30 received within housing 22 thereby defining fluid retention cavity 40. When one of wipers 50, 60, or 70 are affixed to housing 22 and extend into fluid retention cavity 40, fluid retention cavity 40 is bifurcated into first minor cavity 47 and second minor cavity 48. Any fluid flow from first minor cavity 47 to second minor cavity 48 or the reverse thereof must pass through the respective aperture sets in wipers 50, 60, or 70. Wipers 50, 60, and 70 can also have located substantially at and extending below their respective inner ends 52, 62, or 72 resilient seals 82 to facilitate a fluid seal between wipers 50, 60, or 70 and central core 34.

Figure 16:
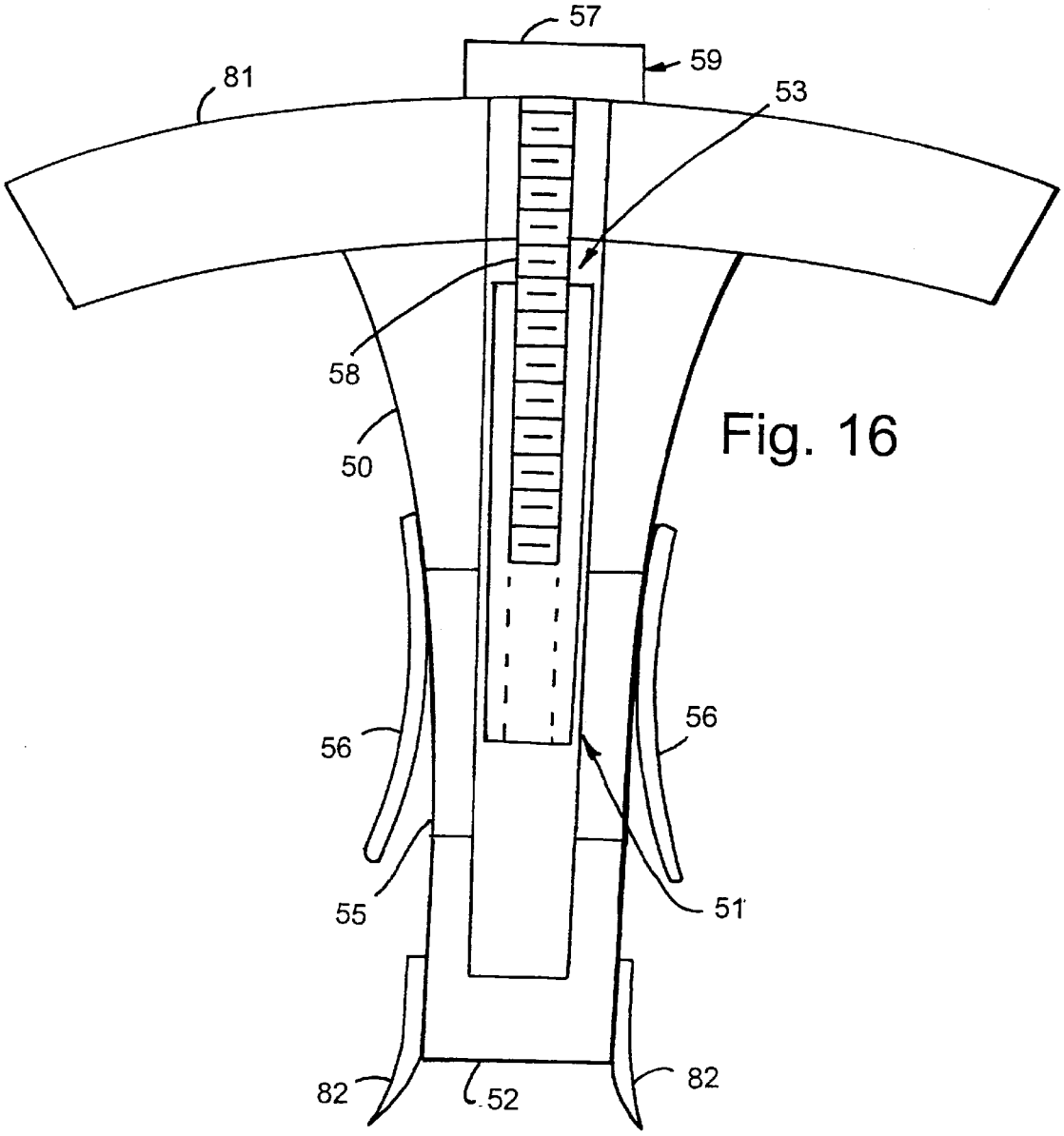
FIG. 16 is a cross-sectional view of a damper wiper showing an adjustable gate.

Referring to FIG. 16, a combined damper wiper 50 and wiper cap 81 is shown in cross section illustrating an adjustable gate 51 within damper wiper 50 for adjusting the cross-sectional area of apertures 54 and 55. Damper wiper 50 has a vertical slot 53 in vertical registration with and extending through each of apertures 55 and 54. A vertically adjustable gate 51 is received within each of slots 53. An adjuster 57 extends from an exterior portion of wiper cap 81 into slot 53 and engages vertically adjustable gate 51 such that activation of adjuster 57 can alternately raise and lower gate 51 within slot 53. The raising and lowering of gate 51 within slot 53 effectively changes the cross-sectional area of apertures 54 and 55. Since the damping characteristics of a rotationally pivotal motion control incorporating a damper wiper, such as damper wiper 50, is a function of the cross-sectional area of apertures 54 and 55 regulating the flow rate of operating fluid therethrough, the damping characteristics of such an axial motion controller can be varied according to the desires and requirements of the user by activating adjustor 57 to either raise or lower gate 51 within slot 53. As shown in FIG. 16, adjustor 57 comprises a threaded shaft 58 which extends through wiper cap 81 and engages gate 51 such that rotation of head 59 attached to threaded shaft 58 results in the desired raising or lowering of gate 51 within apertures 54 and 55. Such external adjustment capability permits the ready varying of the damping characteristics of an axial motion controller configured as a damper without necessitating the removal and replacement of wiper 50.

Figure 5:
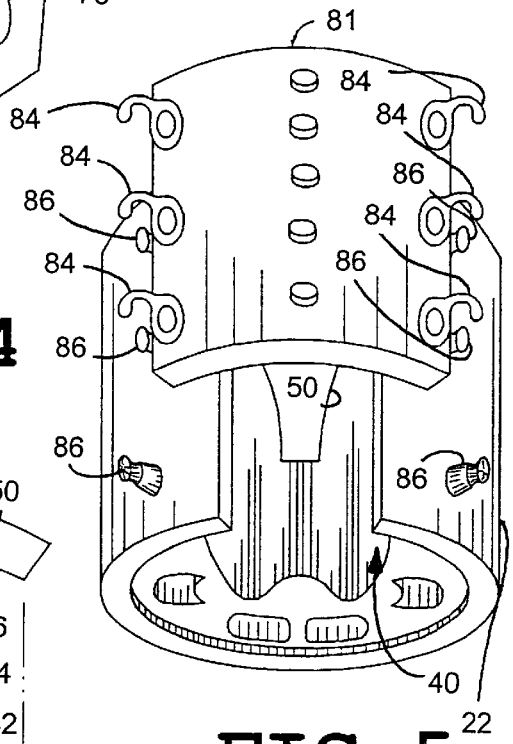
FIG. 5 is a perspective view of a hub within the housing showing the attachment of a wiper and wiper cap to the housing.

FIG. 5 illustrates one suggested embodiment for fastening a wiper cap such as wiper cap 81 to housing 22. In this embodiment, wiper cap 81 has a plurality of rotatable hooks 84 which, when wiper cap 81 is seated on housing 22, can be rotated to engage posts 86 and thereby retain wiper 50 within fluid retention cavity 40. Alternately, posts 86 can be eliminated and rotatable hooks 84 can be replaced by a common fasteners such as screws to securely retain wiper cap 81 in fixed relationship to housing 22.

Figure 9:
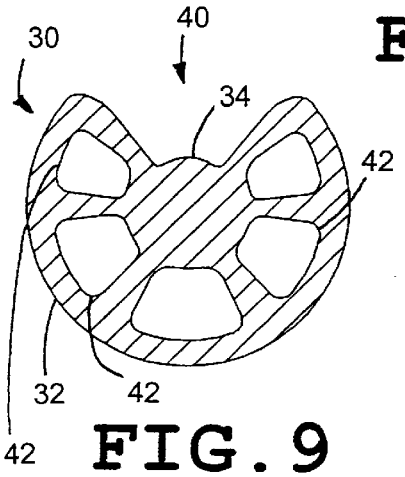
FIG. 9 is a cross-sectional view of a hub having one lobe.
Figure 10:
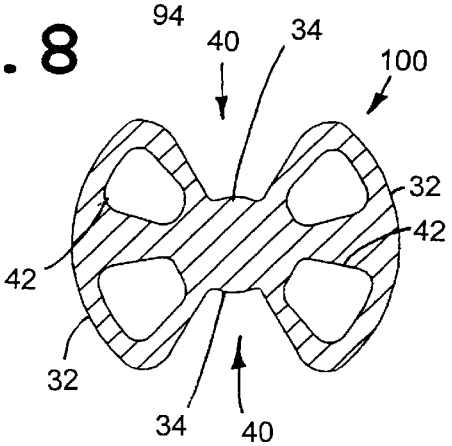
FIG. 10 is a cross-sectional view of a hub having two lobes.
Figure 11:
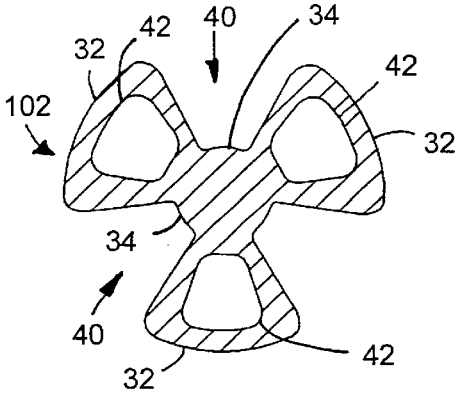
FIG. 11 is a cross-sectional view of a hub having three lobes.
Figure 12:
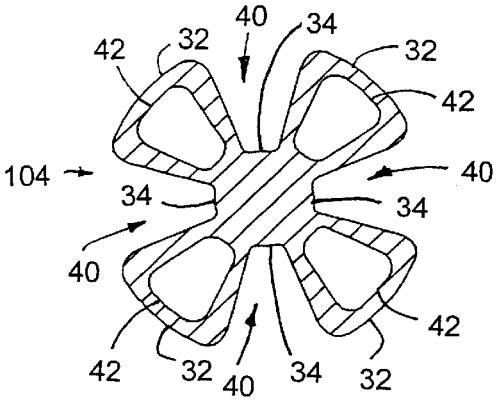
FIG. 12 is a cross-sectional view of a hub having four lobes.

FIGS. 9–12 illustrate alternate hub configurations. FIG. 9 illustrates hub 30 as previously discussed above wherein hub 30 has one lobe 32 and a plurality of longitudinal channels 42 extending therethrough. The configuration of lobe 32 can be varied depending on the desired rotational angle through which hub 30 is desired to rotate and has a maximum radial rotational limit of approximately 300°. FIG. 10 illustrates a dual lobe hub 100 wherein two lobes 32 are substantially equally spaced about central cylindrical core 34. Dual lobe hub 100 has a maximum rotational limit of approximately 100°. FIG. 11 illustrates a triple lobe hub 102 defining three fluid retention cavities 40 therearound, each lobe 32 being substantially equi-spaced about central cylindrical core 34. The maximum rotational limit of triple lobe hub 102 is approximately 60°. FIG. 12 illustrates quadruple lobe hub 104 having four lobes 32 substantially equi-spaced about central cylindrical core 34. The maximum rotational movement of the quadruple lobed hub 104 is approximately 30°. At least a portion of fluid retention cavities 40 in each hub configuration between adjacent lobes 32 are defined by sides of lobes 32. Each lobe 32 can have one or more longitudinal channels 42 therethrough.

Figure 13:
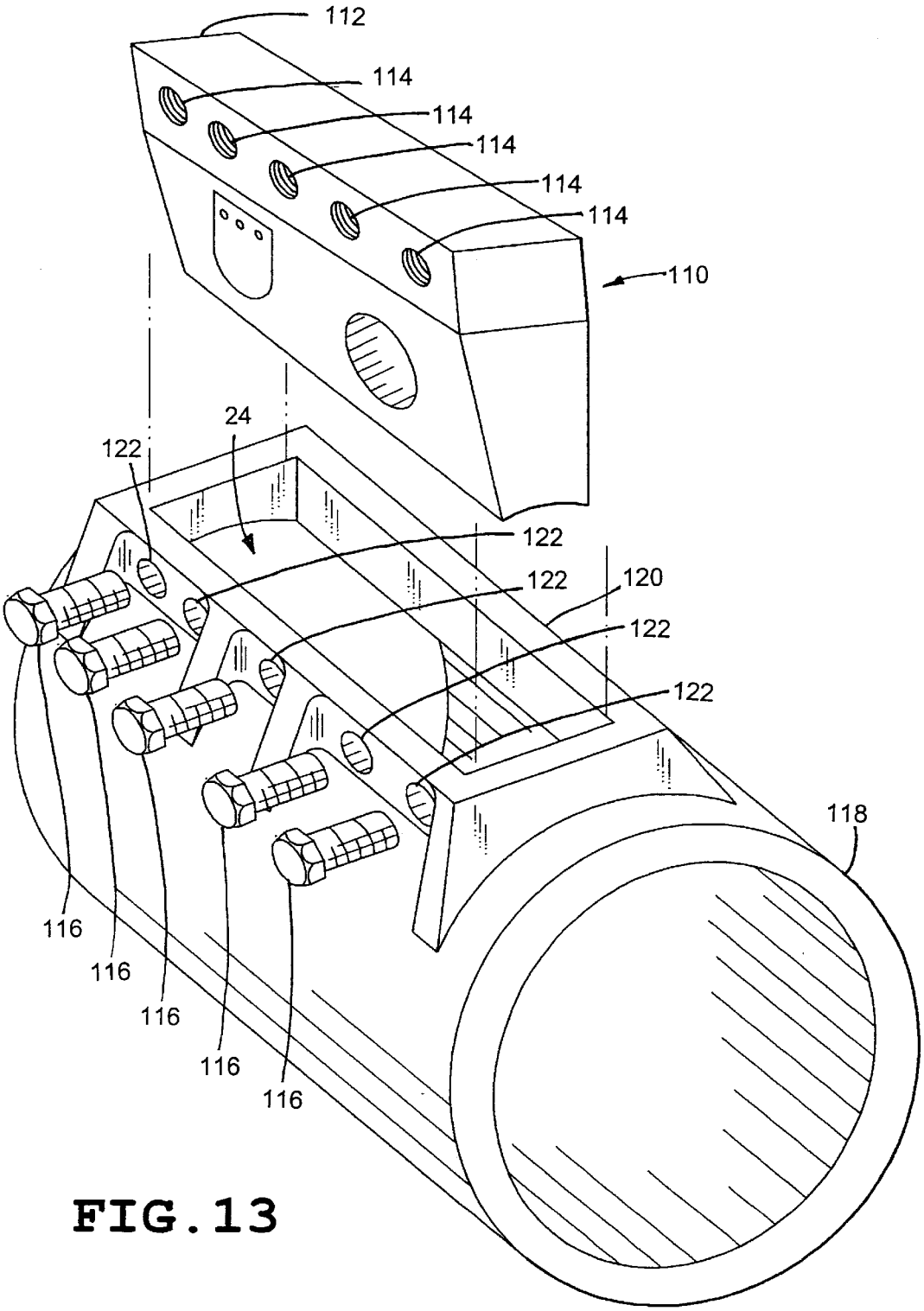
FIG. 13 is an exploded perspective view of a housing having radially extending flanges for the attachment of a wiper therein.

Referring now to FIG. 13, an alternate embodiment of a wiper 110 is here shown configured as a damper wiper to illustrate an alternate attachment of a wiper to a housing. Wiper 110 has an upper portion 112 which has a plurality of holes 114 extending laterally therein and configured to receive fasteners 116. Alternate embodiment housing 118 has an outwardly extending radial flange 120 about the periphery of longitudinal aperture 24. Wiper 110, when inserted into aperture 24 and fastened in place with fasteners 116 is closely sealed by the engagement of fasteners 116 through holes 122 of flange 120 and engaging holes 114 in upper portion 112 of wiper 110.

Figure 14:
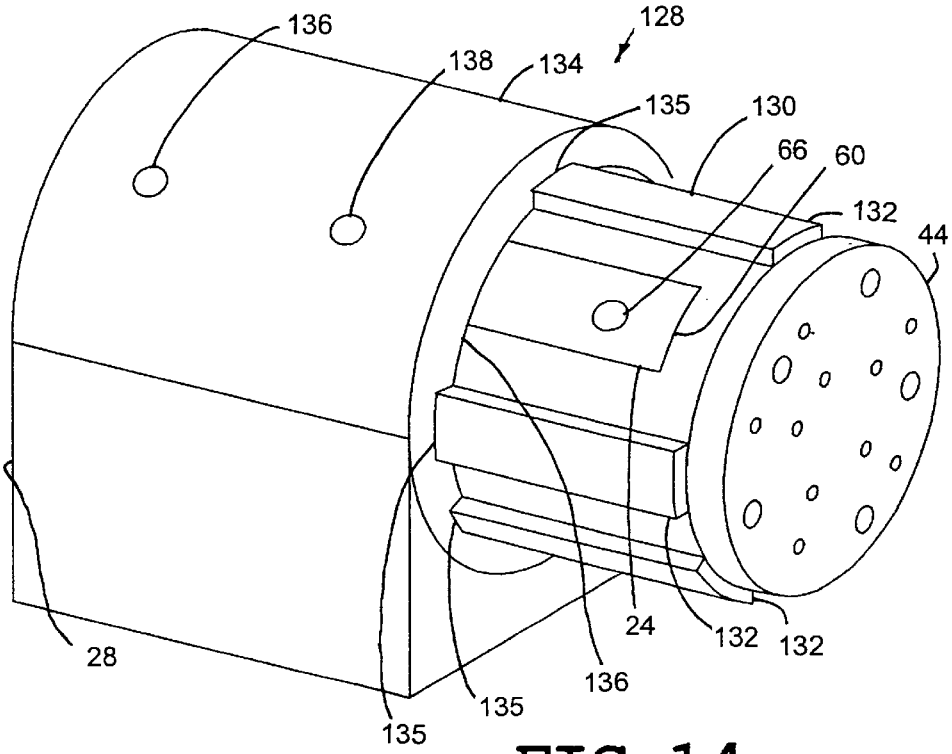
FIG. 14 is a perspective view of an alternate wiper retention embodiment wherein the housing and hub assembly combination is telescopically received within an outer sleeve.

Referring now to FIG. 14, yet another alternate embodiment 128 for sealing and retaining a wiper such as wiper 60 is illustrated. In this embodiment, a housing 130 has external longitudinally extending splines 132 and shows actuator wiper 60 engaged in aperture 24. End cap 44 is fastened to and retains a hub (not shown) within housing 130 in a manner as described above. External sleeve 134 has a substantially longitudinally aligned cylindrical bore 136 therethrough, wherein cylindrical bore 136 closely receives housing 130 and grooves 135 receive splines 132 of housing 130 to maintain housing 130 in a fixed angular relationship with sleeve 134. Sleeve 134 is continuous over wiper 60 and thereby retains wiper 60 in fluidically sealed relationship in aperture 24. Sleeve 134 also has apertures 137 and 138 therethrough in registration with apertures 64 and 66 of wiper 60 to facilitate the flow of working fluid 91 therethrough from an external fluid pump such as pump 90 (FIG. 8). Attachment feature 28 in this alternate embodiment is attached to sleeve 134 in lieu of housing 130.

FIG. 15 illustrates in end cross-sectional view one embodiment of a multi-function axial motion controller 139 including a housing 140 having three apertures 24 therearound for receiving three wipers. A triple-lobed hub 102 is received within housing 140 in the embodiment shown in FIG. 15. Triple-lobed hub 102 defines in combination with housing 140 three separate fluid retention cavities 40 into each of which extends one wiper through each of apertures 24. One aperture 24 has extending therethrough a damper wiper 150 similar to damper wiper 50 which permits fluid flow through wiper 150 via apertures therethrough sides to regulate the rotational rate of hub 102 with respect to housing 140 by taking advantage of the viscous properties of a working fluid. A second wiper, actuator wiper 160, extends through a second aperture 24 to facilitate the operation of the hub and housing as a rotary actuator in a manner as described above. The rotation rate of hub 102 with respect to housing 140 is regulated by the damping effect of damper wiper 150. A third wiper, pump wiper 170 extends through a third aperture 24. Pump wiper 170 is similar in configuration to pump wiper 70 with a plurality of apertures and one-way valves wherein the pumping of operating fluid is induced rotational actuation of hub 102 within housing 140 by the fluid transfer from fluid pump 90 through actuator wiper 160. The fluid within cavity 40 associated with pump wiper 170 is circulated through cooling radiator 172 to dissipate heat generated in axial motion controller 139 during operation thereof. As hub 102 is reciprocally rotated within housing 140, the fluid within the cavity 40 associated with pump wiper 170 is circulated in a manner through the apertures and one-way valves similar to that described above with respect to pump wiper 70 (FIG. 4).

While FIG. 15 illustrates a three function rotationally pivotal motion controller, it will be understood that a multi-function axial motion controller can incorporate a number of wipers consistent with the number of lobes 32 and fluid retention cavities 40 of a desired controller configuration. Any combination of like or differing wipers such as wipers 50, 60, and 70 can be incorporated in the controller to facilitate desired functions in a particular application.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

The invention claimed is:

1. A rotationally pivotal controller for pivotally interconnecting two adjoining elements and controlling the pivotal motion of a first of the two adjoining elements with respect to a second of the two adjoining elements, said rotationally pivotal motion controller comprising:

a housing having a wall defining an axial cylindrical bore through said housing, said wall adapted for attachment to a first of the two adjoining elements and further having a longitudinal aperture therethrough communicating with said bore;

a hub assembly comprising a hub at least partially disposed within said cylindrical bore of said housing and rotatable therein, said hub having a substantially central cylindrical core and at least one lobe extending radially therefrom, and at least one end cap affixed to one end of said hub retaining said hub in a fixed, fluidically sealed, co-axial relationship within said housing, said hub and said housing together defining at least one fluid retention cavity, said hub assembly adapted for attachment to a second of the two adjoining elements; and a removable wiper positioned in said aperture and sealingly affixed to said housing and removable without disassembling said hub assembly from said housing, said wiper extending radially inwardly from said housing wall within said at least one fluid retention cavity substantially to said central cylindrical core and dividing said at least one fluid retention cavity into a first minor cavity and a second minor cavity.

2. The rotationally pivotal motion controller according to claim 1 further comprising:

a viscous fluid retained within said first and said second minor cavities; and wherein said wiper configures said rotationally pivotal motion controller as a rotational motion damper.

3. The rotationally pivotal motion controller according to claim 2 wherein:

said wiper has at least one aperture therethrough fluidically connecting said first minor cavity with said second minor cavity, and further wherein said aperture is sized with respect to viscous properties of the viscous fluid to regulate a rotation rate of said hub assembly with respect to said housing.

4. The rotationally pivotal motion controller according to claim 3 wherein:

said wiper has a vertical slot therein intersecting with said at least one aperture;

an adjustable gate is received in said vertical slot; and an adjuster extends from an exterior of said rotationally pivotal motion controller into said vertical slot and movably engaging said adjustable gate to regulate the size of said aperture to regulate said rotation rate.

5. The rotationally pivotal motion controller according to claim 4 wherein:

said wiper has at least two apertures therethrough fluidically connecting said first minor cavity with said second minor cavity, at least a first one-way valve attached to a first side of said wiper at a first aperture location permitting a flow of said viscous fluid in a first direction, and at least a second one-way valve attached to an opposite side of said wiper at a second aperture location permitting flow of said viscous fluid in a second opposite direction.

6. The rotationally pivotal motion controller according to claim 1 further comprising:

a fluid retained within said first and said second minor cavities; and wherein said wiper configures said rotationally pivotal motion controller as a pivotal motion actuator.

7. The rotationally pivotal motion controller according to claim 6 wherein:

said wiper has at least two apertures therethrough, a first aperture fluidically communicating between said first minor cavity and an exterior of said rotationally pivotal motion controller, and a second aperture fluidically communicating between said second minor cavity and an exterior of said rotationally pivotal motion controller.

8. The rotationally pivotal motion controller according to claim 7 further comprising:

a fluid pump fluidically connected to said at least two apertures in said wiper, said fluid pump supplying an alternating forced fluid flow through said apertures inducing a forced reciprocating pivotal motion of said hub assembly with respect to said housing.

9. The rotationally pivotal motion controller according to claim 1 further comprising:

a fluid retained within said first and said second minor cavities; and wherein said wiper configures said rotationally pivotal motion controller as a pivotal motion pump.

10. The rotationally pivotal motion controller according to claim 9 wherein:

said wiper has at least four apertures therethrough, a first supply aperture and a first return aperture fluidically communicating between said first minor cavity and an exterior of said rotationally pivotal motion controller, and a second supply aperture and a second return aperture fluidically communicating between said second minor cavity and an exterior of said rotationally pivotal motion controller.

11. The rotationally pivotal motion controller according to claim 10 further comprising:

first and second supply aperture valves affixed to said wiper, said first supply aperture valve allowing fluid flow only from said first minor cavity to said exterior of said rotationally pivotal motion controller, and said second supply aperture valve allowing fluid flow only from said second minor cavity to said exterior of said rotationally pivotal motion controller; and first and second return aperture valves affixed to said wiper, said first return aperture valve allowing fluid flow only from said exterior of said rotationally pivotal motion controller to said first minor cavity, and said second return aperture valve allowing fluid flow only from said exterior of said rotationally pivotal motion controller to said second minor cavity.

12. The rotationally pivotal motion controller according to claim 11 further comprising:

an accessory apparatus fluidically interconnected to said first and second supply apertures and to said first and second return apertures wherein said accessory apparatus is operated by said fluid pumped as a result of reciprocating pivotal motion of said hub assembly with respect to said housing.

13. The rotationally pivotal motion controller according to claim 1 wherein:

said hub assembly comprises a hub having a plurality of lobes therearound and extending from said central core, said central core, adjacent lobes and said housing defining a plurality of fluid retention cavities;

said housing has a plurality of longitudinal apertures therethrough, each longitudinal aperture substantially in registration with one of said fluid retention cavities; and a plurality of removable wipers, each of said plurality of removable wipers positioned in one of said longitudinal apertures and sealingly affixed to said housing.

14. The rotationally pivotal motion controller according to claim 13 wherein:

at least a first wiper of said plurality of removable wipers is selected from the group consisting of a damper wiper, an actuator wiper, and a pump wiper, and at least a non-identical second wiper of said plurality of removable wipers is selected from the group consisting of a damper wiper, an actuator wiper, and a pump wiper.

15. The rotationally pivotal motion controller according to claim 14 wherein:

said plurality of lobes are substantially equi-angularly disposed about a central longitudinal axis of said central core.

16. The rotationally pivotal motion controller according to claim 15 wherein:

said plurality of lobes are substantially of equal size.

17. The rotationally pivotal motion controller according to claim 1 further comprising:

means for affixing said wiper to said housing.

18. The rotationally pivotal motion controller according to claim 17 wherein:

said affixing means is a wiper cap conforming to an exterior contour of said housing and fastened to said exterior contour of said housing, said wiper depending from said wiper cap through said longitudinal aperture.

19. The rotationally pivotal motion controller according to claim 17 wherein:

said affixing means is at least one flange extending radially outward from said housing substantially at an edge of said longitudinal aperture; and at least one fastener fastening said wiper to said flange.

20. The rotationally pivotal motion controller according to claim 18 wherein:

said housing has external longitudinal splines; and said affixing means is an external sleeve having substantially mating internal splines, telescopically receiving said housing and hub assembly therein.

21. The rotationally pivotal motion controller according to claim 1 wherein:

said removable wiper is interchangeable with a second removable wiper wherein interchanging of said removable wiper with said second removable wiper changes functional characteristics of said rotationally pivotal motion controller.

22. The rotationally pivotal motion controller according to claim 1 wherein:

said at least one lobe has two sides extending radially from said core to said housing, said sides defining at least a portion of said fluid retention cavity, and further wherein pivotal rotation limits of said hub assembly with respect to said housing are defined by an angular relationship of said sides defining said fluid retention cavity.

23. The rotationally pivotal motion controller according to claim 1 wherein:

said hub assembly has at least one longitudinal passageway through said at least one end cap and said at least one lobe for passage therethrough of a cooling fluid to remove heat from an interior of said rotationally pivotal motion controller.

24. The rotationally pivotal motion controller according to claim 1 wherein: said hub assembly has an end cap affixed at each end of said hub, retaining said hub in a fixed, fluidically sealed, co-axial relationship within said housing.

25. A rotationally pivotal motion controller for pivotally interconnecting two adjoining elements and controlling the pivotal motion of a first of the two adjoining elements with respect to a second of the two adjoining elements, said rotationally pivotal motion controller comprising:

a housing having a wall defining an axial cylindrical bore through said housing, said wall adapted for attachment to a first of the two adjoining elements and further having a plurality of longitudinal apertures therethrough communicating with said bore;

a hub assembly comprising a hub at least partially disposed within said cylindrical bore of said housing and rotatable therein, said hub having a substantially central cylindrical core and a plurality of lobes extending radially therefrom, and at least one end cap affixed to one end of said hub retaining said hub in a fixed, fluidically sealed, co-axial relationship within said housing, said hub and said housing together defining a plurality of fluid retention cavities, said hub assembly adapted for attachment to a second of the two adjoining elements; and a plurality of removable wipers positioned in said apertures and sealingly affixed to said housing and removable without disassembling said hub assembly from said housing, one of said plurality of wipers extending radially inwardly from said housing wall at each aperture within each of said fluid retention cavities substantially to said central cylindrical core and dividing each of said fluid retention cavities into a first minor cavity and a second minor cavity.

26. The rotationally pivotal motion controller according to claim 25 further comprising:

a fluid retained within each of said fluid retention cavities.

27. The rotationally pivotal motion controller according to claim 26 wherein:

at least a first wiper of said plurality of removable wipers is selected from the group consisting of a damper wiper, an actuator wiper, and a pump wiper, and at least a non-identical second wiper of said plurality of removable wipers is selected from the group consisting of a damper wiper, an actuator wiper, and a pump wiper.

28. The rotationally pivotal motion controller according to claim 27 wherein:

at least one wiper is a pump wiper and configures at least a portion of said rotationally pivotal motion controller as a pivotal motion pump for inducing forced circulation of said fluid within one of said fluid retention cavities to an accessory apparatus fluidically interconnected to said pump wiper as a result of reciprocating pivotal motion of said hub assembly with respect to said housing.

29. The rotationally pivotal motion controller according to claim 27 wherein:

at least one of said wipers is an actuator wiper and configures at least a portion of said rotationally pivotal motion controller as a pivotal motion actuator; and further comprising:

a fluid pump fluidically connected to said actuator wiper, said fluid pump supplying an alternating forced fluid flow through said apertures inducing a forced reciprocating pivotal motion of said hub assembly with respect to said housing.

30. The rotationally pivotal motion controller according to claim 27 wherein:

at least one wiper is a damper wiper and configures at least a portion of said rotationally pivotal motion controller as a pivotal motion damper for regulating a rate of rotation between said housing and said hub assembly.

31. A rotationally pivotal motion controller for pivotally interconnecting two adjoining elements and controlling the pivotal motion of a first of the two adjoining elements with respect to a second of the two adjoining elements, said rotationally pivotal motion controller comprising:

a housing having a wall defining an axial cylindrical bore through said housing, said wall adapted for attachment to a first of the two adjoining elements and further having a plurality of longitudinal apertures therethrough communicating with said bore;

a hub assembly comprising a hub at least partially disposed within said cylindrical bore of said housing and rotatable therein, said hub having a central cylindrical core and a plurality of lobes extending radially therefrom, and at least one end cap affixed to one end of said hub retaining said hub in a fixed, fluidically sealed, co-axial relationship within said housing, said hub assembly and said housing together defining a plurality of fluid retention cavities, said hub assembly adapted for attachment to a second of the two adjoining elements;

a plurality of wipers positioned in said aperture and sealingly affixed to said housing, one of said plurality of wipers extending radially inwardly from said housing wall at each of said apertures within each of said fluid retention cavities substantially to said central cylindrical core and dividing each of said fluid retention cavities into a first minor cavity and a second minor cavity wherein at least a first of said plurality of wipers is a damper wiper and configures at least a first portion of said rotationally pivotal motion controller as a pivotal motion damper for regulating a rate of rotation between said housing and said hub assembly, and further wherein at least a second of said plurality of wipers is a pump wiper and configures at least a second portion of said rotationally pivotal motion controller as a pivotal motion pump for inducing forced circulation of said fluid from one of said fluid retention cavities as a result of reciprocating pivotal motion of said hub assembly with respect to said housing; and a cooling radiator having an inlet fluidically interconnected to said pump wiper for receiving heated fluid from said housing and hub assembly, a cooling portion to lower the temperature of said fluid and an outlet fluidically interconnected to said pump wiper for returning cooled fluid to said fluid retention cavity associated with said pump wiper.

* * * * *